US008505738B2

(12) United States Patent
O'Keeffe et al.

(10) Patent No.: US 8,505,738 B2
(45) Date of Patent: Aug. 13, 2013

(54) MATERIAL SCREENING APPARATUS

(75) Inventors: Eric O'Keeffe, County Monaghan (IE); Barry Aughey, County Monaghan (IE)

(73) Assignee: Aughey Research and Designs Limited, Killyconnlgan (IE)

( * ) Notice: Subject to any disclaimer, the term of this patent is extended or adjusted under 35 U.S.C. 154(b) by 857 days.

(21) Appl. No.: 12/278,459

(22) PCT Filed: Feb. 16, 2007

(86) PCT No.: PCT/EP2007/051537

§ 371 (c)(1),
(2), (4) Date: Aug. 6, 2008

(87) PCT Pub. No.: WO2007/093645

PCT Pub. Date: Aug. 23, 2007

(65) Prior Publication Data

US 2009/0173671 A1 Jul. 9, 2009

(30) Foreign Application Priority Data

Feb. 16, 2006 (IE) ..... S2006/0114

(51) Int. Cl.
*B07B 1/49* (2006.01)
*B07B 1/00* (2006.01)

(52) U.S. Cl.
USPC ..... 209/421; 209/240

(58) Field of Classification Search
USPC ..... 209/240, 241, 243, 244, 247, 255, 209/257, 409, 420, 421, 930, 284, 288, 337, 209/342
See application file for complete search history.

(56) References Cited

U.S. PATENT DOCUMENTS 3,016,203 A * 1/1962 Sears et al. ..... 241/24.1
3,439,806 A * 4/1969 Kass et al. ..... 209/260
4,105,544 A * 8/1978 Stevick ..... 209/317

(Continued)

FOREIGN PATENT DOCUMENTS

EP 0641607 A2 8/1995
EP 1526219 A2 * 4/2005

(Continued)

OTHER PUBLICATIONS

International Search Report of PCT/EP2007/051537 issued Aug. 16, 2007.

(Continued)

*Primary Examiner* — Stefanos Karmis
*Assistant Examiner* — Michael E Butler
(74) *Attorney, Agent, or Firm* — Sanford Astor; Brooks Kushman P.C.

(57) ABSTRACT

A mobile material screening apparatus (100) for separating bulk particulate material into groups of particles of differing sizes comprises a support chassis (2), a horizontal screen box (3) housed within the support chassis (2) and an additional inclined pre-screening module (50) which is adapted to be demountably attached to the support chassis (2). The mobile screening apparatus (100) comprises five outputs. Foldable conveyors (7*a*, 8, 9, 910, 920) can be deployed outwardly from and stowed inwardly against the material screening apparatus. The provision of an inclined pre-screening module (50) provides relief to the horizontal screen box (3) by first removing the larger sized particles from the bulk material which can be returned to a crusher for recycling and serves also to increase the total number of grades of material separated by the screening apparatus.

18 Claims, 17 Drawing Sheets

(56) References Cited

U.S. PATENT DOCUMENTS

| | | | | | |
|---|---|---|---|---|---|
| 4,256,572 | A | * | 3/1981 | Read | 209/257 |
| 4,322,288 | A | * | 3/1982 | Schmidt | 209/356 |
| 4,383,651 | A | * | 5/1983 | Couperus | 241/81 |
| 4,983,280 | A | * | 1/1991 | Eriksson | 209/241 |
| 5,106,490 | A | * | 4/1992 | McDonald | 209/240 |
| 5,120,433 | A | * | 6/1992 | Osadchuk | 209/235 |
| 5,193,971 | A | * | 3/1993 | Pettijohn | 414/523 |
| 5,234,564 | A | * | 8/1993 | Smith | 209/241 |
| 5,248,042 | A | * | 9/1993 | Kuhmonen | 209/234 |
| 5,275,293 | A | * | 1/1994 | Crider | 209/319 |
| 5,577,618 | A | * | 11/1996 | Rafferty | 209/421 |
| 5,622,265 | A | * | 4/1997 | Drenter et al. | 209/221 |
| 5,975,441 | A | * | 11/1999 | Burkholder | 241/24.12 |
| 6,006,921 | A | * | 12/1999 | Zehr | 209/288 |
| 6,065,606 | A | * | 5/2000 | Bonner | 209/420 |
| 6,186,338 | B1 | * | 2/2001 | Douglas | 209/421 |
| 6,405,874 | B1 | * | 6/2002 | Douglas | 209/421 |
| 6,726,025 | B1 | * | 4/2004 | Huskey | 209/421 |
| 6,843,376 | B2 | * | 1/2005 | Dube et al. | 209/421 |
| 7,273,150 | B2 | * | 9/2007 | Fridman et al. | 209/420 |
| 7,552,818 | B2 | * | 6/2009 | Makinen et al. | 198/861.2 |
| 2003/0146315 | A1 | * | 8/2003 | Boast | 241/101.72 |
| 2004/0182758 | A1 | * | 9/2004 | McCloskey | 209/420 |

FOREIGN PATENT DOCUMENTS

| | | | | |
|---|---|---|---|---|
| EP | 1526219 | A3 | | 4/2005 |
| GB | 1480688 | | * | 7/1977 |
| GB | 2302514 | A | | 1/1997 |
| IE | 990732 | A1 | | 12/2000 |
| IE | 20050413 | A2 | | 12/2006 |
| WO | WO 2004/011159 | A1 | | 2/2004 |

OTHER PUBLICATIONS

GB Search Report of GB Application 0612088.5 issued Oct. 12, 2006.

* cited by examiner

MATERIAL SCREENING APPARATUS

TECHNICAL FIELD

The present invention relates to a material screening apparatus for separating bulk particulate material into groups of particles of differing sizes.

BACKGROUND ART

A mobile screening apparatus is known whereby the material to be screened is fed via an apron feeder which receives and conveys said material onto a horizontal screen box with two decks, an upper deck where the largest particles are removed and a lower deck. Particles having a smaller size fall through the upper screen deck onto the lower screen deck below. At the lower screen deck, particles of the next largest size grouping are separated from the remaining smaller particulate matter which falls through the lower screen deck.

Elongate conveyers, which are mounted to and extend away from the screening apparatus, convey the separated materials to three distinct and separate locations where they are deposited in stockpiles, according to particle grade.

It is quite common to require five grades of material, namely a reject or oversized material and four different grades of screened material. This is achieved by using two screening apparatus together in series.

It is therefore an object of all the present invention to alleviate the disadvantages associated with the prior art.

SUMMARY OF THE INVENTION

The present invention is more particularly defined in the appended claims which are incorporated in this description by reference.

DESCRIPTION OF THE PREFERRED EMBODIMENTS

The invention will hereinafter be more particularly described with reference to the accompanying drawings which show, by way of example only, the screening apparatus of the invention.

IN THE DRAWINGS

Figure 5A:
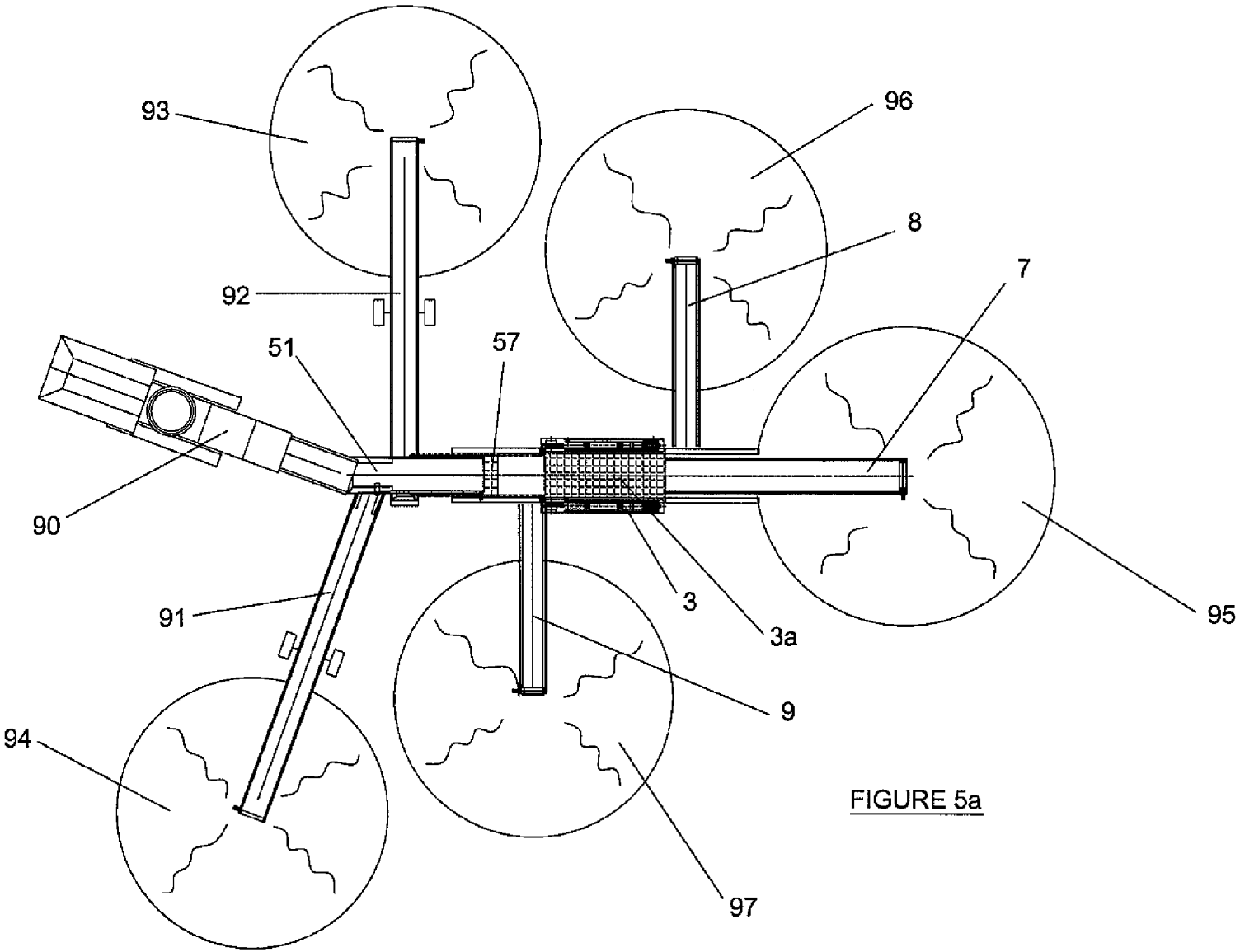
Figure 5B:
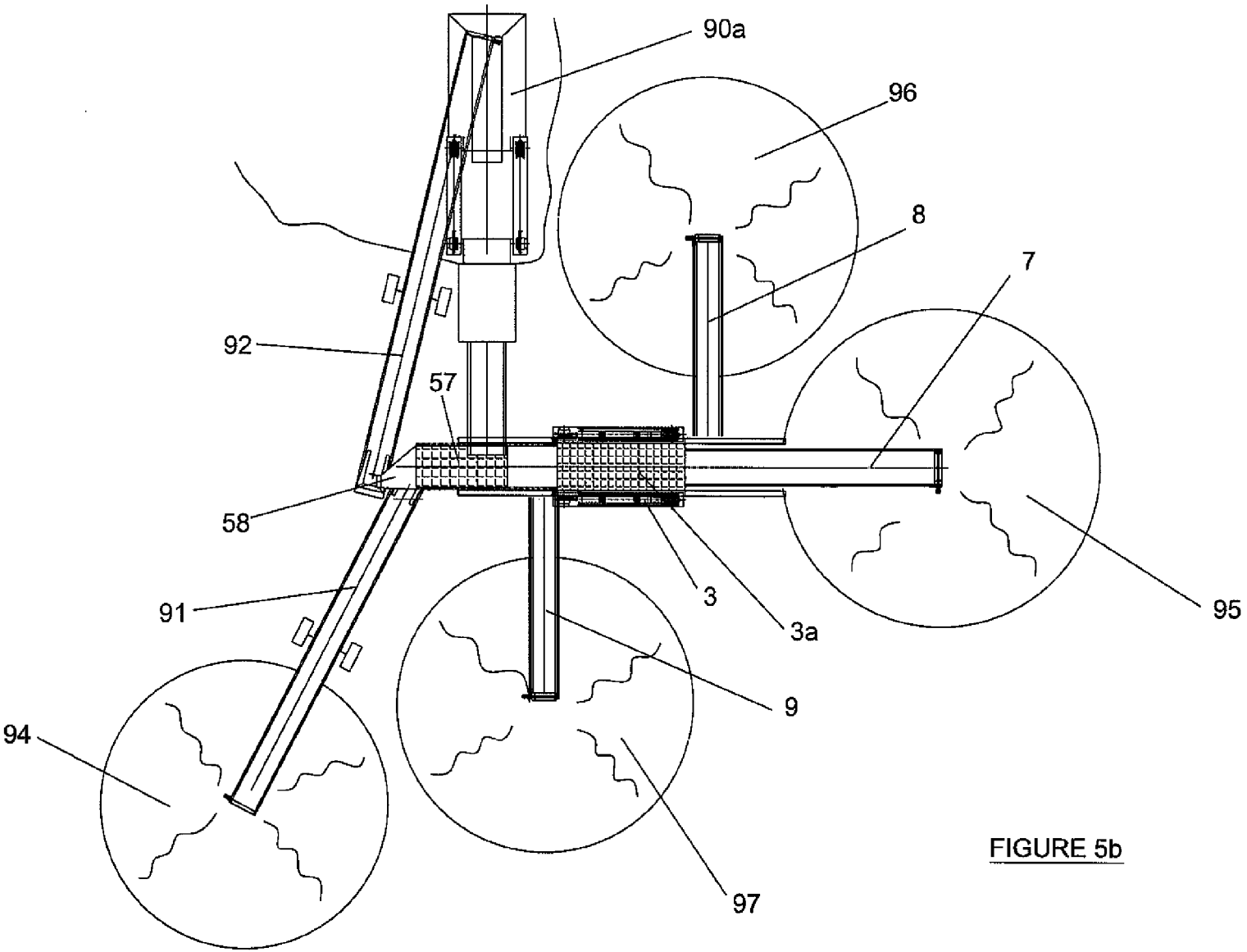
Figure 6A:
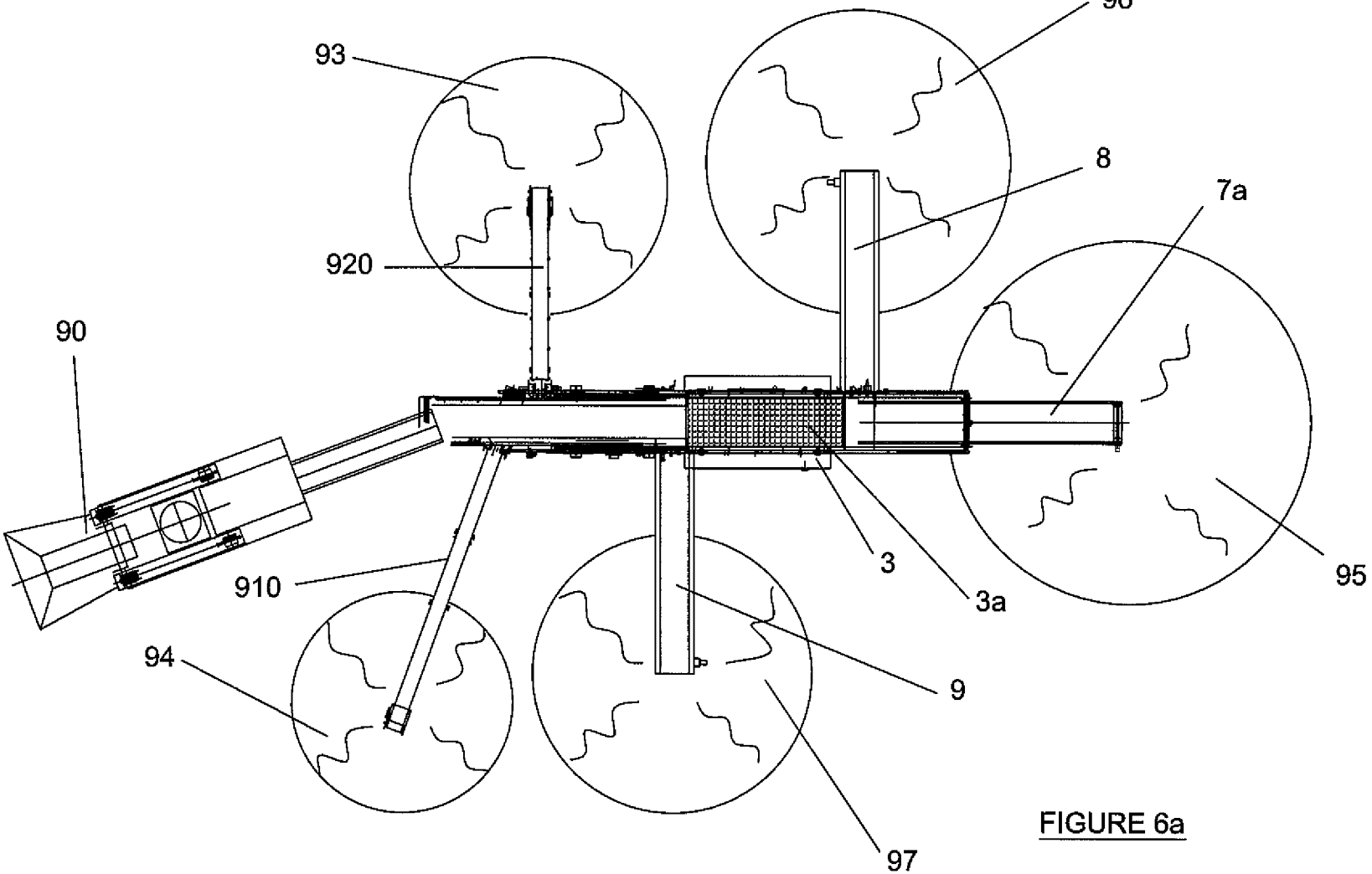
Figure 6B:
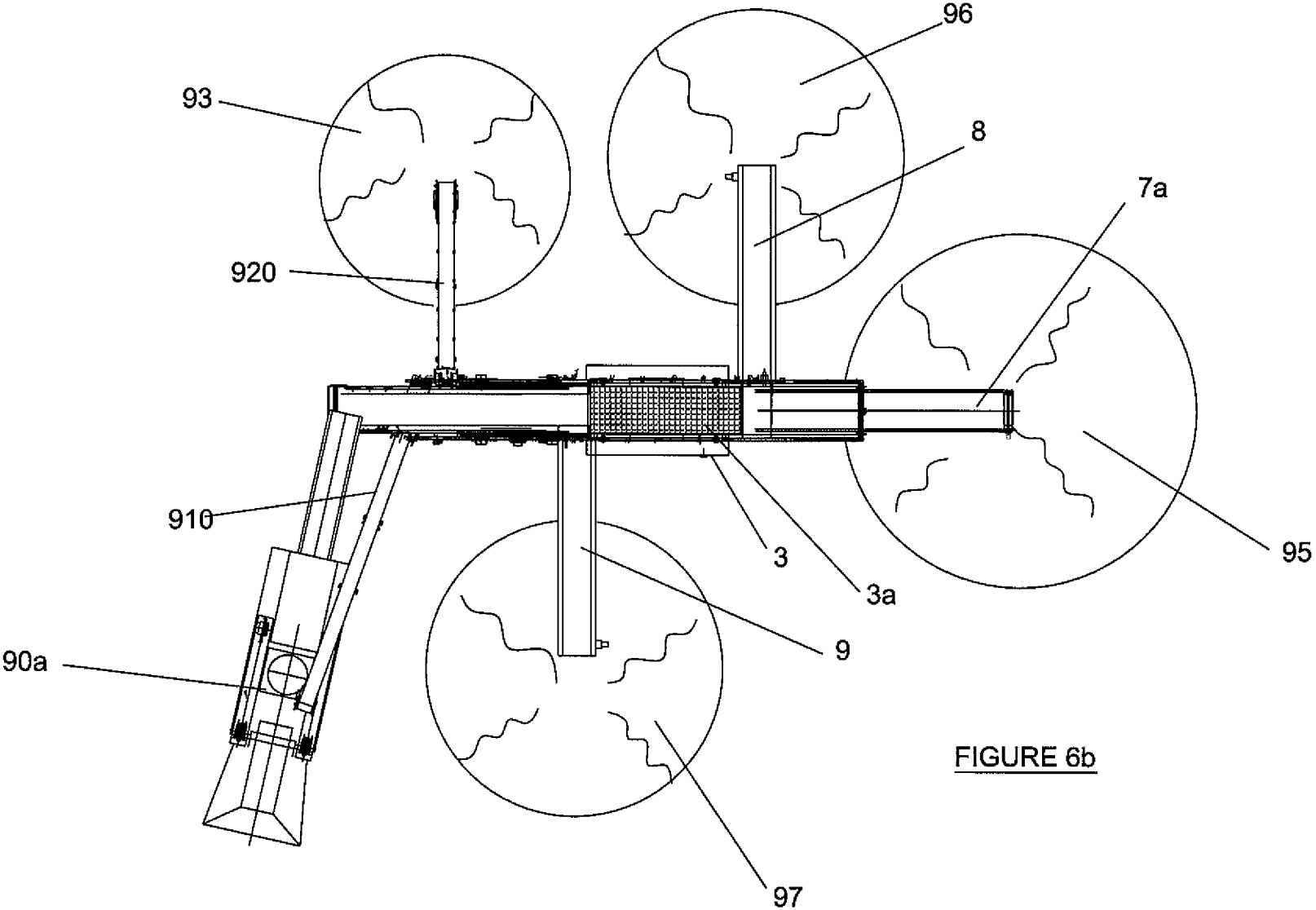
Figure 7A:
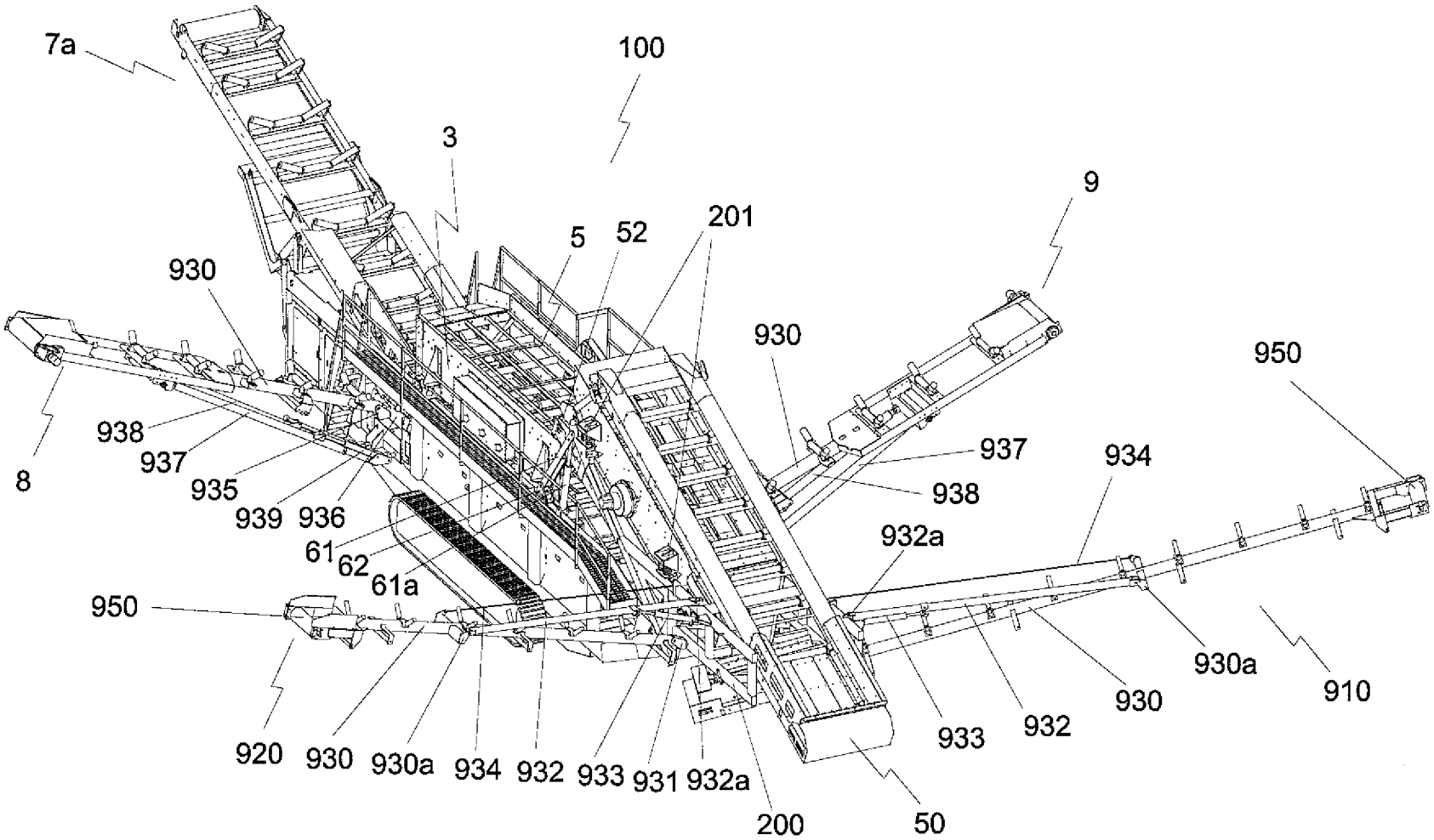
Figure 7B:
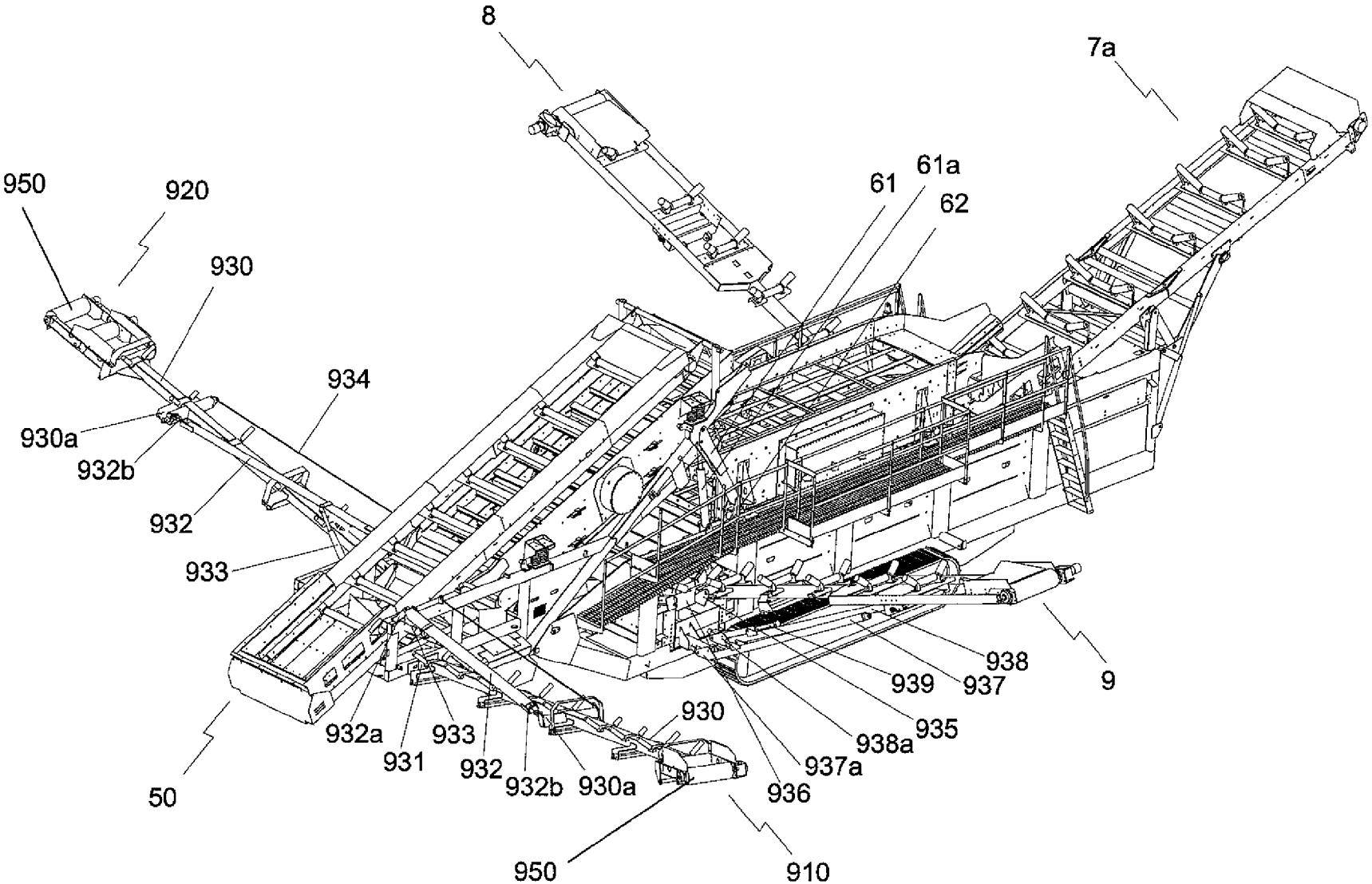
Figure 7C:
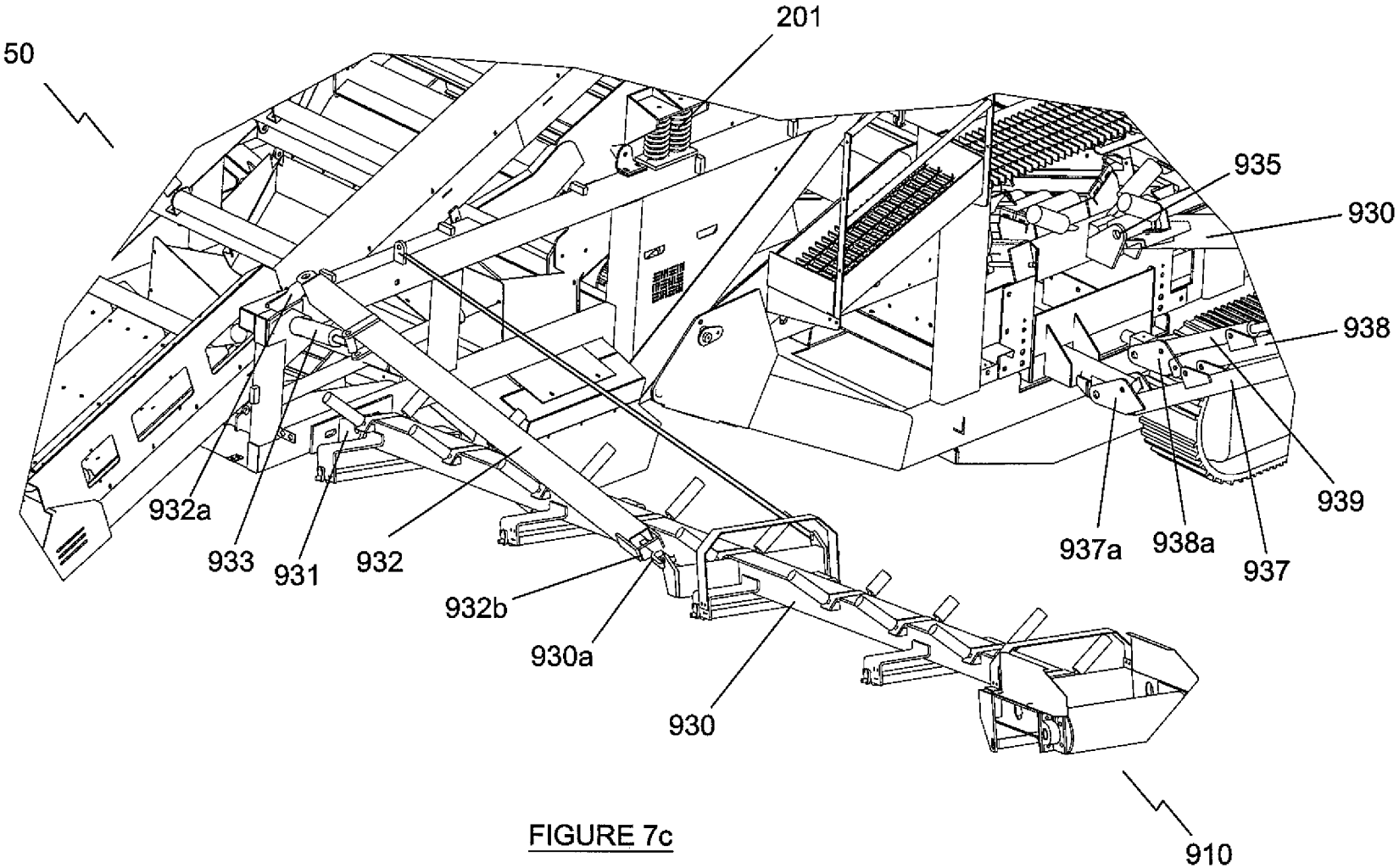
Figure 8A:
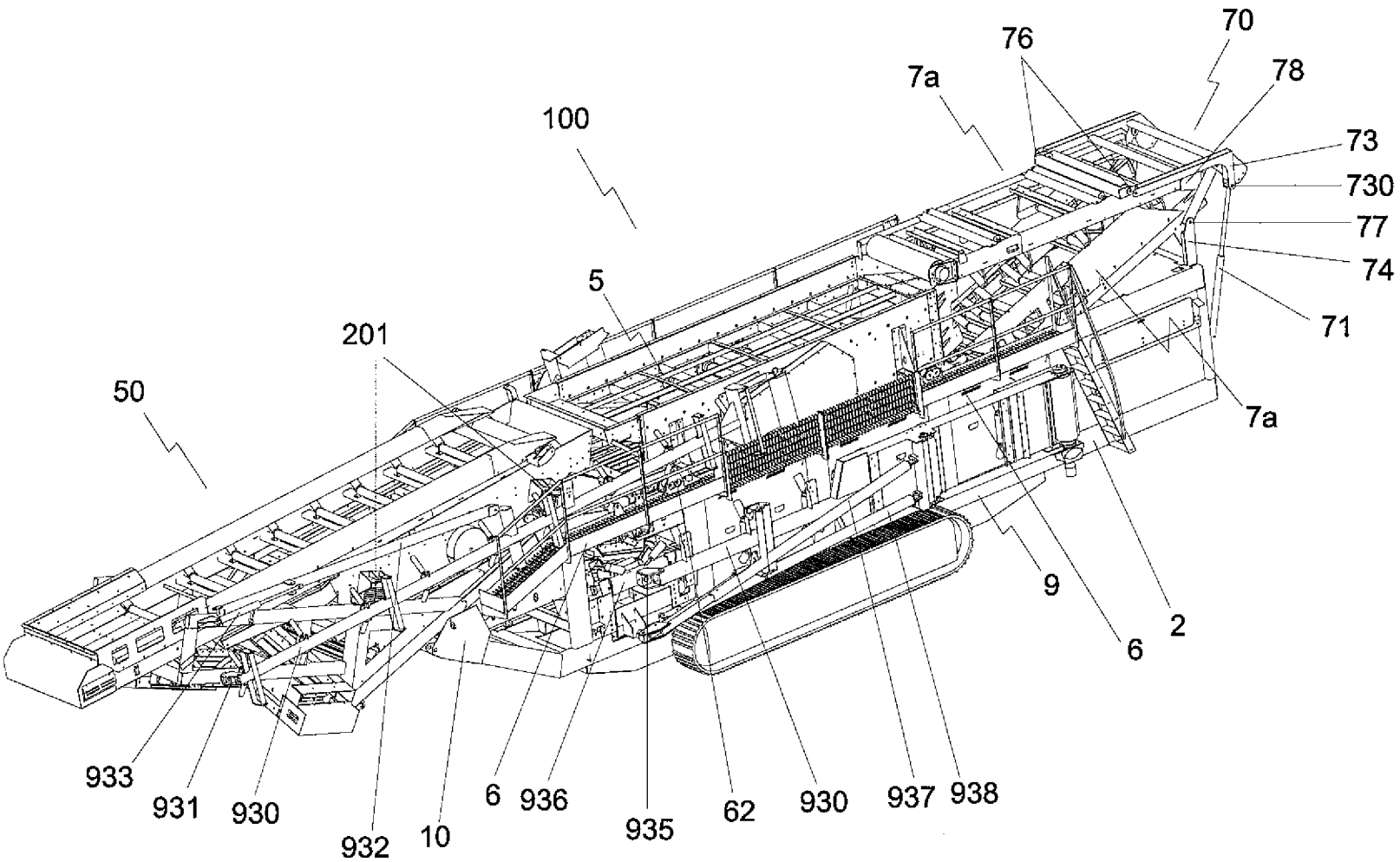
Figure 8B:
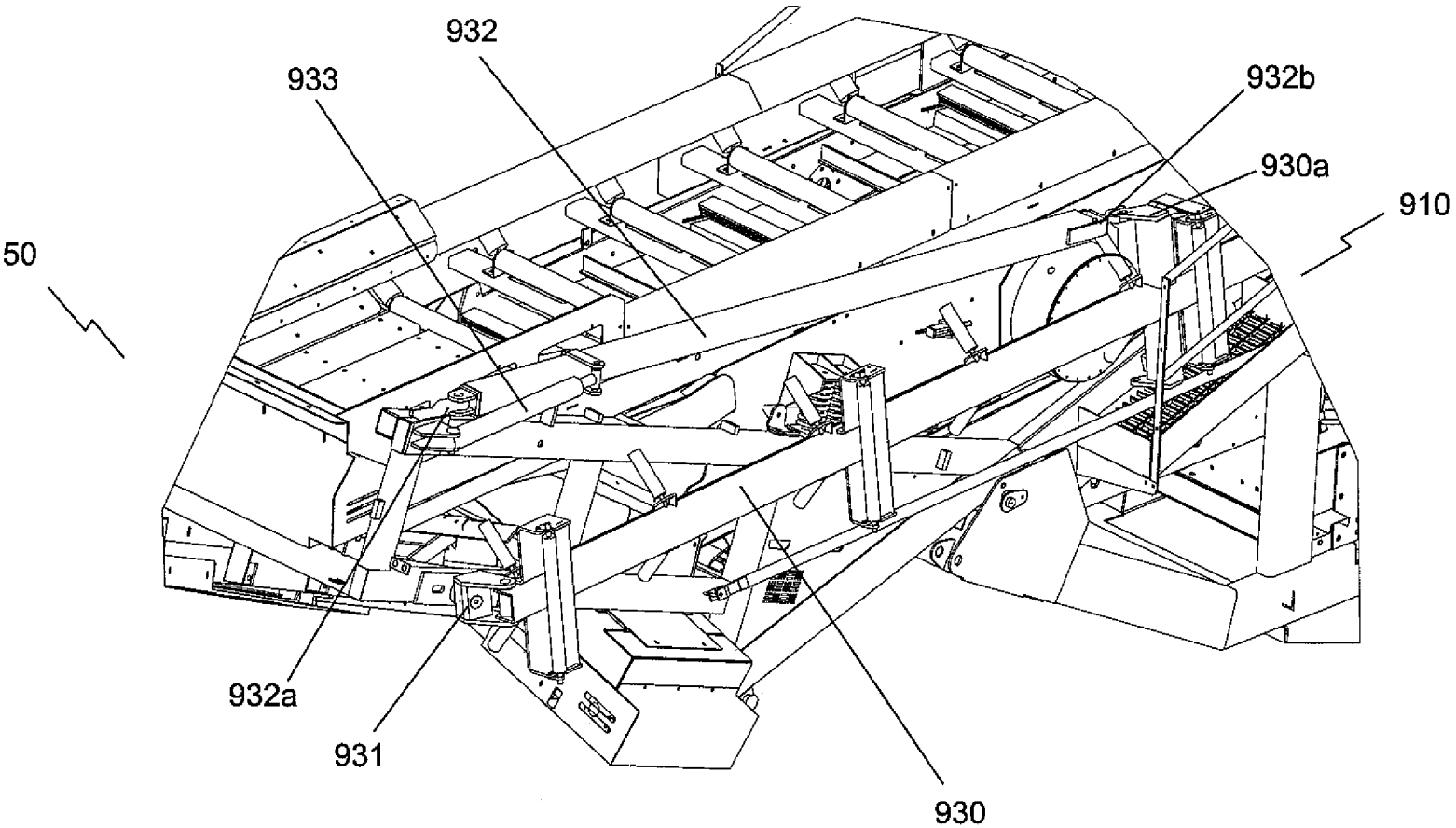
Figure 9A:
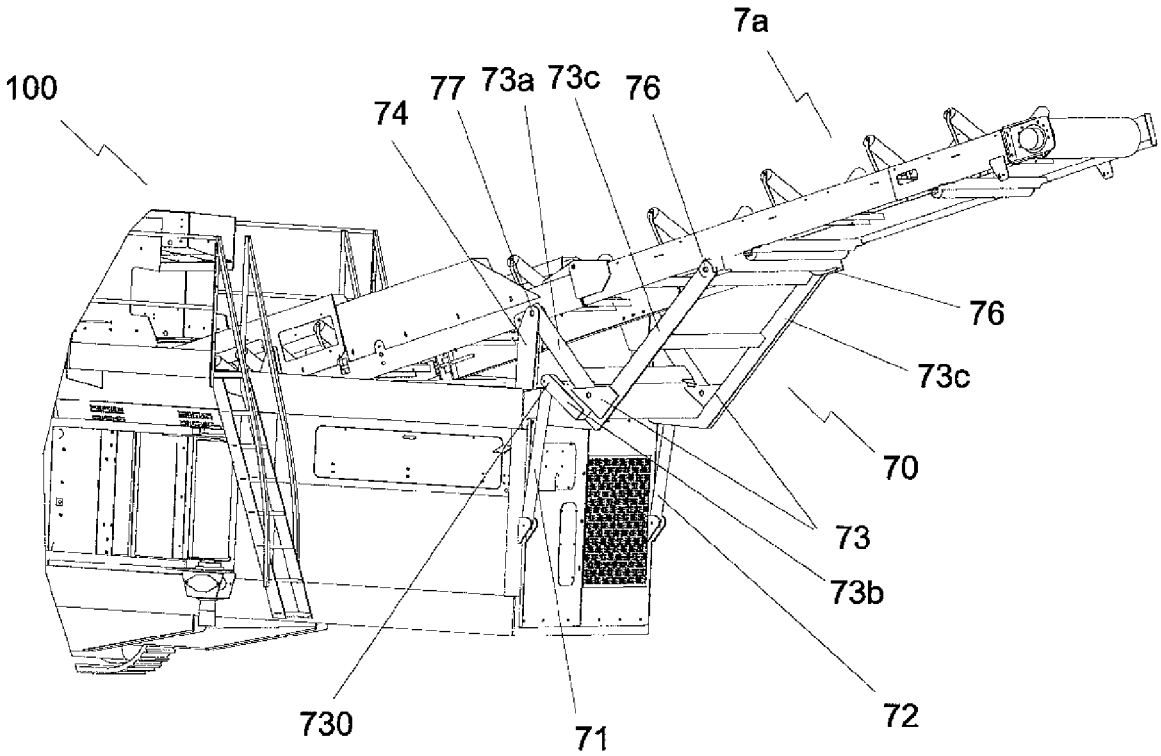
Figure 9B:
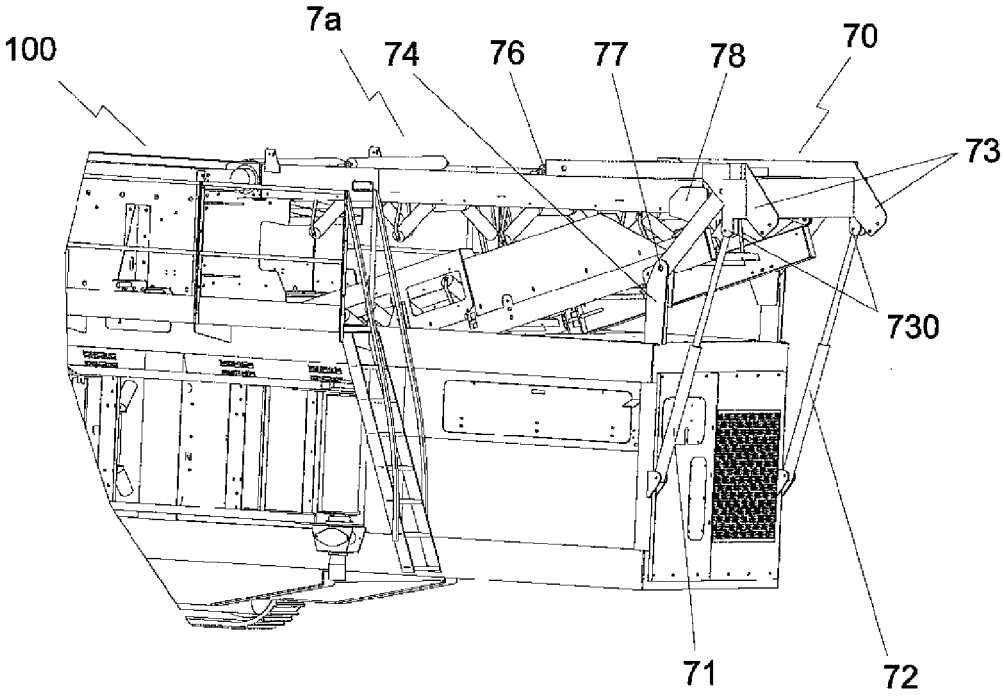
Figure 10A:
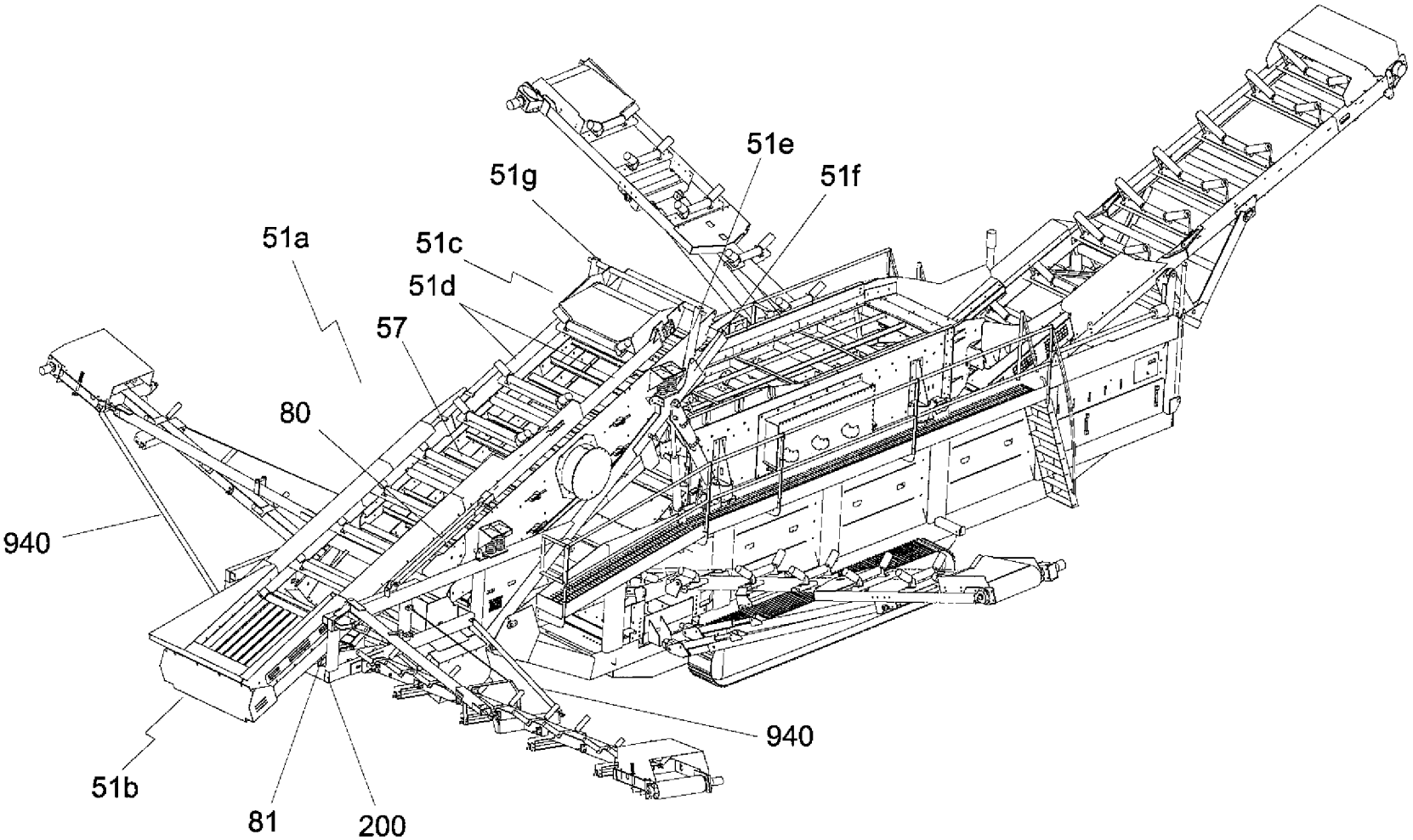
Figure 10B:
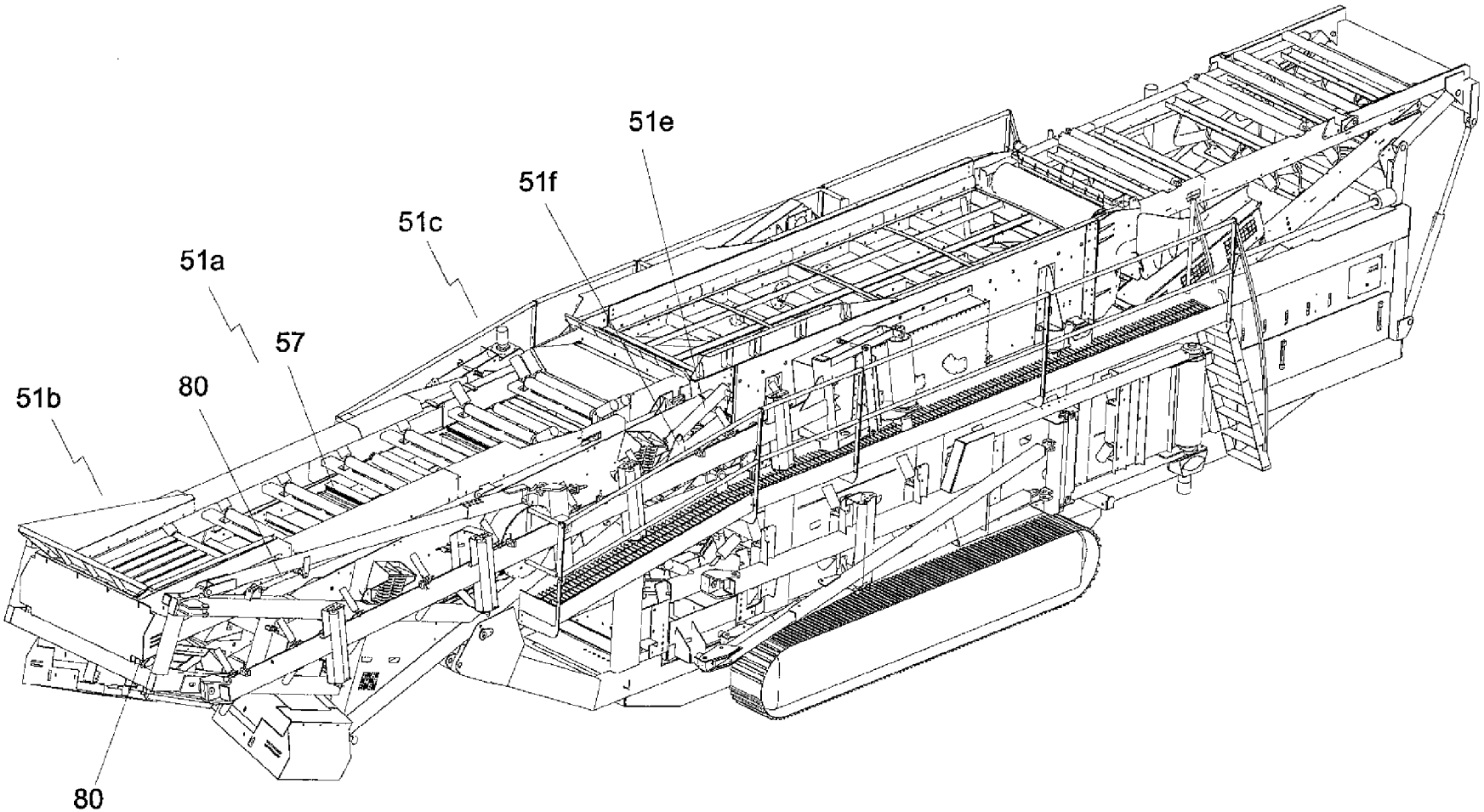
Figure 10C:
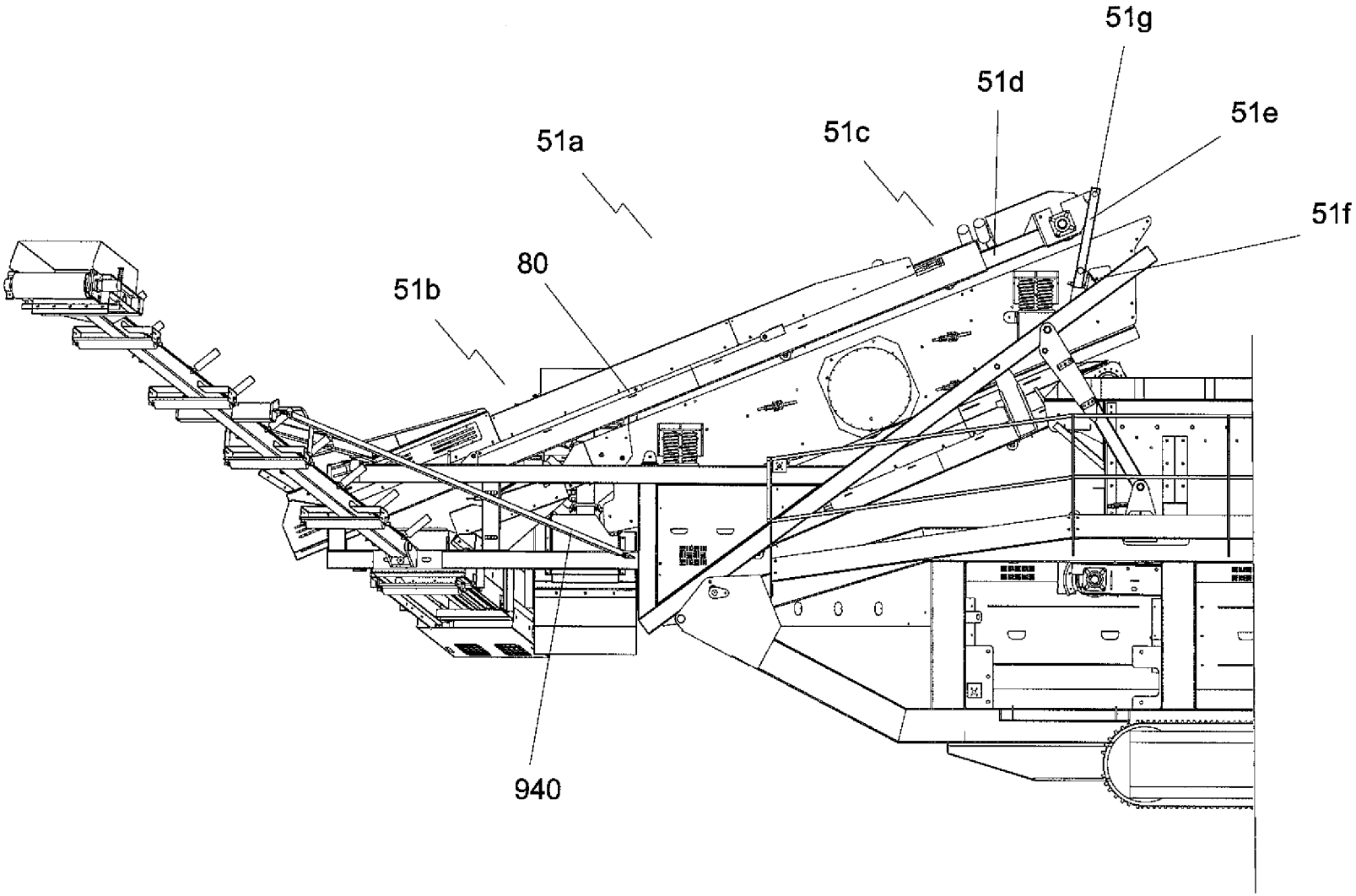

FIG. 5*a* is a schematic plan view of a screening apparatus of the invention shown on-site and in its operating mode;

FIG. 5*b* is a schematic plan view of a screening apparatus of the invention shown on-site and in an alternative operating mode;

FIG. 6*a* is a schematic plan view of a preferred embodiment of a screening apparatus of the invention shown on-site and in its operating mode;

FIG. 6*b* is a schematic plan view of the preferred embodiment of a screening apparatus of the invention shown on-site and in an alternative operating mode;

FIGS. 7*a* and 7*b* are isometric illustrations of the preferred embodiment of a screening apparatus of the invention shown in its operating mode;

FIG. 7*c* is a detailed illustration of the connection of a conveyor to the pre-screening module 50 when in a deployed position;

FIG. 8*a* is an isometric illustration of the preferred embodiment of a screening apparatus of the invention shown in its stowed mode;

FIG. 8*b* is a detailed illustration of the connection of a conveyor to the pre-screening module 50 when in a stowed position;

FIG. 9*a* is a schematic illustration of a folding end conveyor of the preferred embodiment of a screening apparatus of the invention shown in an operating mode;

FIG. 9*b* is a schematic illustration of the folding conveyor of the preferred embodiment of a screening apparatus of the invention shown in a stowed mode;

FIG. 10*a* is an isometric illustration of a pre-screening module which comprises a telescopically movable upper conveyor and is shown in a deployed mode;

FIG. 10*b* is an isometric illustration of a pre-screening module which comprises a telescopically movable upper conveyor and is shown in a stowed mode; and FIG. 10*c* is a detailed side elevation a pre-screening module which comprises a telescopically movable upper conveyor and is shown in a retracted mode.

Figure 1:
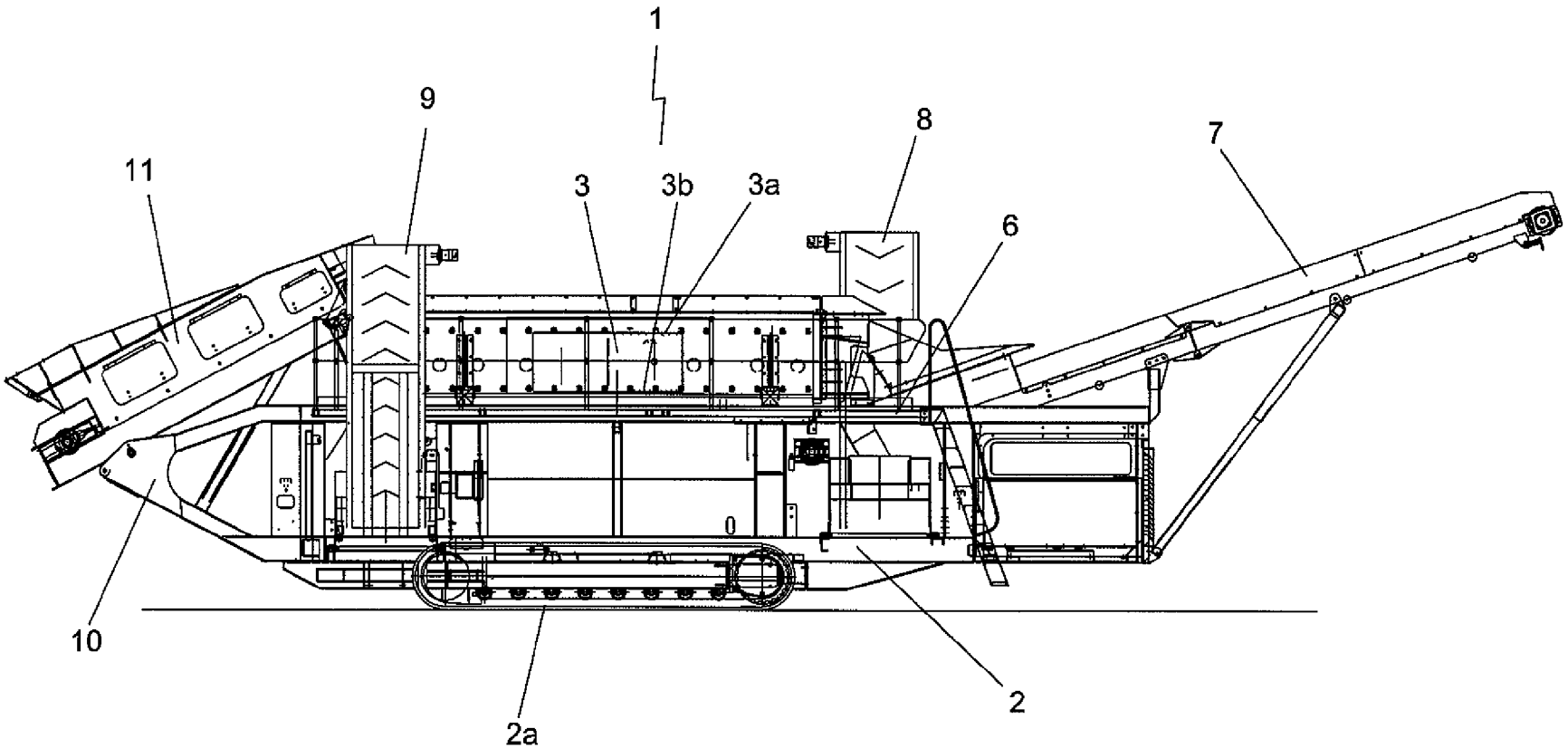
FIGURE 1 (PRIOR ART)
FIG. 1 is a schematic side elevation of a screening apparatus of the prior art having a conventional apron feeder and shown in its operating mode.
Figure 2:
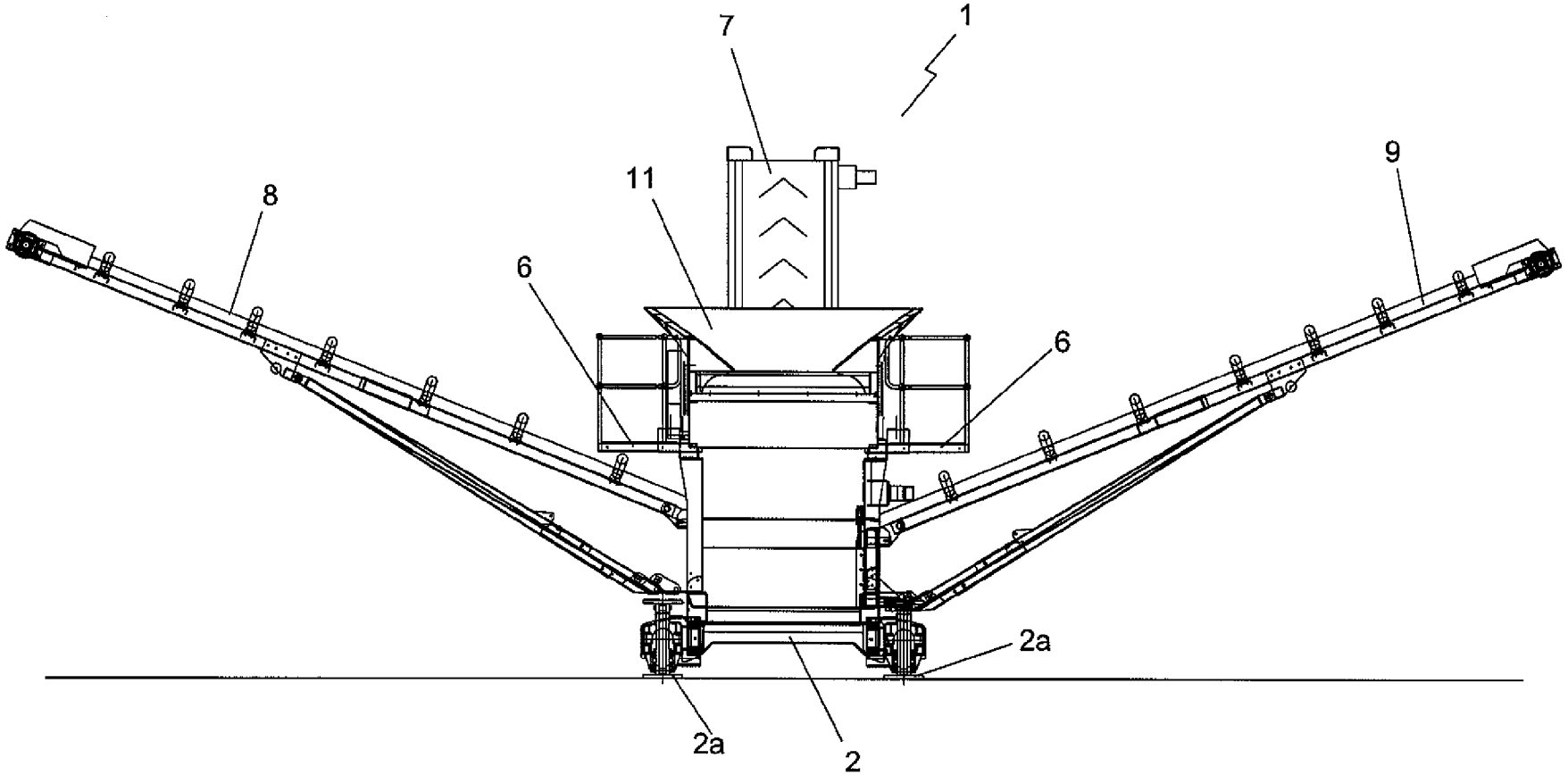
FIGURE 2 (PRIOR ART)
FIG. 2 is a schematic end elevation of a screening apparatus having a conventional apron feeder and shown in its operating mode.

Referring initially to FIG. 1 and FIG. 2, a mobile screening apparatus 1 of the prior art comprises a chassis 2 mounted on tracks 2*a*, a horizontal screen box 3 having an upper screen deck 3*a* and a lower screen deck 3*b*, a catwalk 6, conveyors 7, 8, 9, a rear mount 10 and an apron feeder 11.

Bulk material to be screened is fed via apron feeder 11 to the upper screen deck 3*a* of horizontal screen box 3 which separates the largest particles. Movement of the screen propagates the large particles remaining on the screen surface towards conveyor 7 which conveys them away from the screening apparatus 1 to a remote heap 95, as shown in FIG. 5*a*. All particles that are not screened off at this initial stage fall downwardly through upper upper screen deck 3*a* onto the lower screen deck 3*b* of the horizontal screen box 3. At lower screen deck 3*b*, particles of the next largest size grouping are separated from the remaining smaller particulate matter which falls through the screen. The particles which are retained by lower screen deck 3*b* are removed from the screening apparatus 1 via conveyor 8 which conveys them to a remote heap 96, as shown in FIG. 5*a*. The remaining particles which are sieved off from lower screen deck 3*b* fall downwardly and are transferred via either a chute or a conveyor (not shown) to conveyor 9 which further conveys them to remote heap 97, as shown in FIG. 5*a*.

Figure 3:
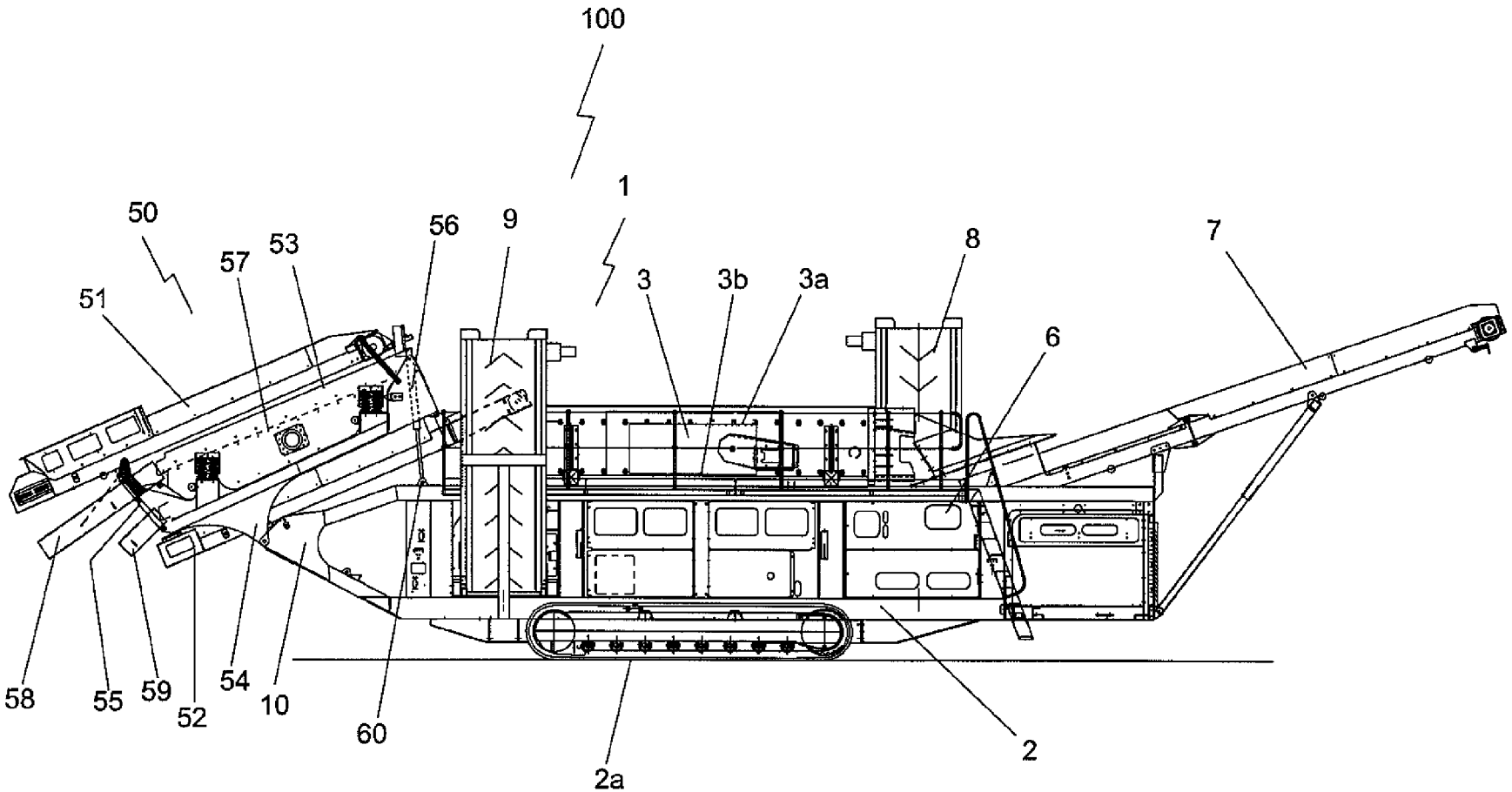
FIG. 3 is a schematic side elevation of a screening apparatus of the invention shown in its operating mode.

Referring now to FIG. 3, the mobile screening apparatus 100 of the invention is shown in its operating configuration. Components of the apparatus indicated by reference numerals 2 through to 10 are common with those of the prior art screening apparatus 1 shown in FIG. 1 and FIG. 2. The mobile screening apparatus 100 of the invention further comprises a pre-screening module indicated generally by the reference numeral 50.

The pre-screening module 50 comprises an upper conveyor 51, a lower conveyor 52, an inclined two-deck screen box 53, a mounting bracket 54, a dual acting folding ram 55 and a dual acting lifting ram 56. The two-deck inclined screen box 53 further comprises an upper inclined screen 57, a lower inclined screen (not shown) and upper and lower chutes 58, 59, respectively.

Figure 4:
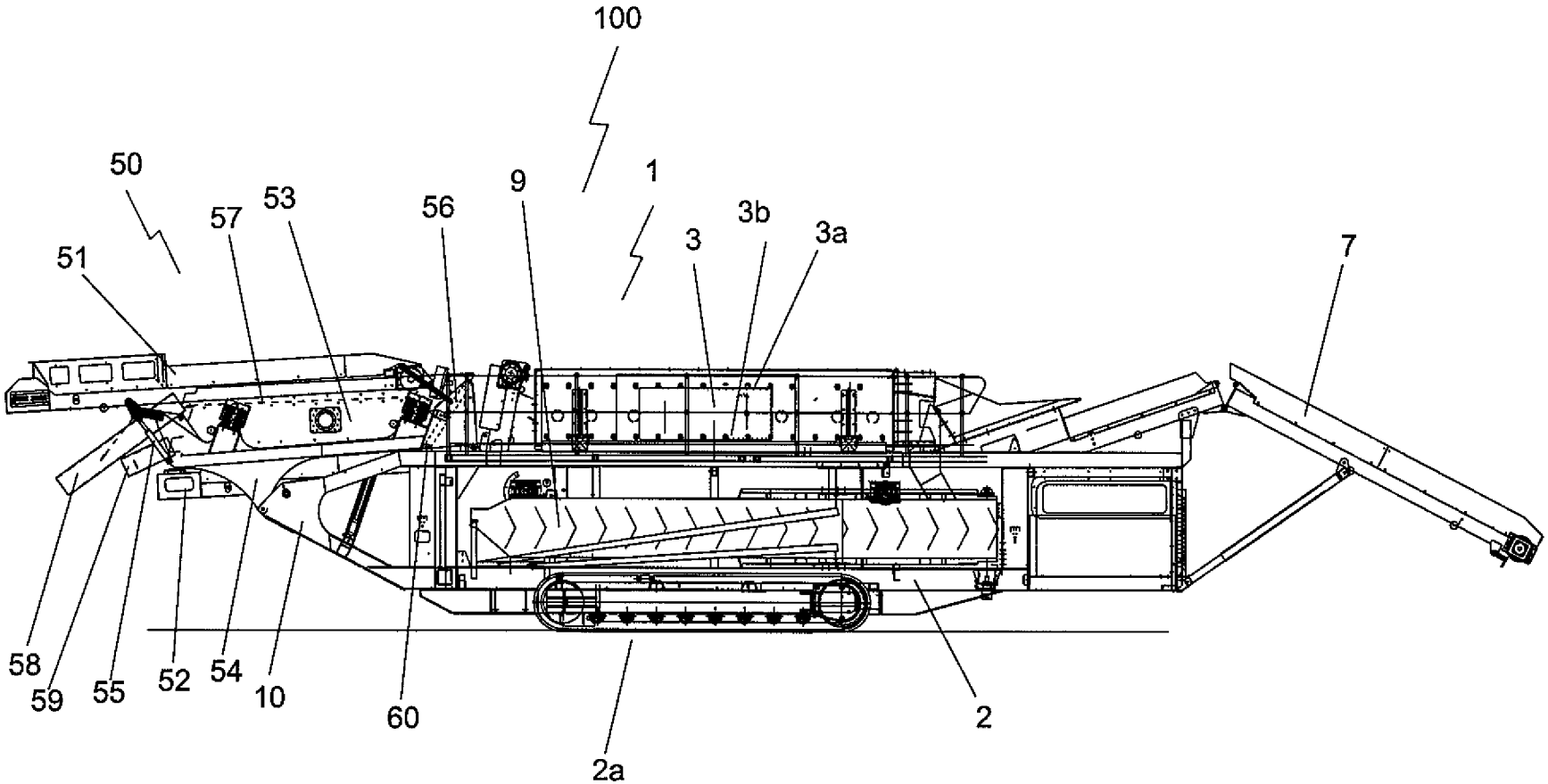
FIG. 4 is a schematic side elevation of the screening apparatus of the invention shown in its stowed mode.

Pre-screening module 50 is pivotally mounted to the screening apparatus 100 via mounting bracket 54 which is adapted to fit onto rear mount 10 such that the module 50 can revert from an inclined operational position as shown in FIG. 3 to a horizontal stowed position as shown in FIG. 4 upon actuation of dual acting lift ram 56 which extends from the rear of the chassis 2 at mounting point 60 to the uppermost portion of the two-deck screen box 53. With the dual acting lifting ram 56 extended the pre-screening module 50 is tilted about rear mount 10 such that the pre-screening module 50 can operate at various inclined angles. In an operational position, extension of dual acting folding ram 55 deploys upper conveyor 51 which thereby rises above two-deck screen box 53.

Referring to FIG. 3 and FIG. 5*a*, the operation of the mobile screening apparatus 100 will be described as follows:

Bulk material, which may be in the form of quarried rocks, stones, gravel, coal, ash or particulate minerals, is transferred from a crusher 90 or transportation means onto the upper conveyor 51 of pre-screening module 50. The bulk material is conveyed upwardly by inclined conveyor 51 until it reaches the uppermost point of the conveyor. At the apex of the conveyor's 51 travel, the bulk material drops into the top portion of the two-deck screen box 53 before travelling downwardly over upper inclined screen 57 where at a first screening stage the largest particles are separated from the bulk material.

The inclination of the screen box 53 assists in the separation of and removal of the large particles which then exit the rear of the screen box 53 via upper chute 58 before being transferred by mobile wheeled stockpiler 91 to a heap 94 as shown in FIG. 5*a*. In an alternative arrangement, shown in FIG. 5*b*, the large particles that exit upper chute 58 may be fed via mobile-wheeled stockpiler 92 back to a crushing device 90*a* which can reprocess the particles before returning the recycled material via a conveyor to the inclined screen 57 for re-screening.

The remaining bulk material falls through the upper inclined screen 57 onto a lower inclined screen below (not shown) for a second screening stage whereby particles in the next largest size range are separated from the bulk material. Particles which are unable to pass through the lower inclined screen exit the rear of the screen box 53 via chute 59 and are then transported by mobile wheeled stockpiler 92 to a heap 93 as shown in FIG. 5*a*.

The bulk material which has passed through both upper 57 and lower inclined screens falls onto continuously moving lower inclined conveyor 52 which elevates to the upper screen deck 3*a* of horizontal screen box 3 on the main mobile screening apparatus 1 for further screening as described previously.

Referring to FIGS. 7*a*, 7*b* and FIG. 8*a*, in a preferred embodiment of the mobile screening apparatus of the invention, pre-screening module 50 is provided with a deploying mechanism that raises the module from a horizontal stowed position (FIG. 8*a*) to an inclined operational position (FIGS. 7*a* and 7*b*) using lifts 61 that extend from mounting point 62 on chassis 2 to the rear of pre-screening module 50. Raising lifts 61, which are actuated by hydraulic lifting rams 61*a*, causes pre-screening module 50 to tilt upwardly about rear mount 10 such that the pre-screening module 50 can operate at various inclined angles. Upon tilting the pre-screening module 50, lifts 61 also serve to pull said module rearwards along a plurality of rollers (not shown) provided on module support structure 200 so that the upper end of lower inclined conveyor 52 is retained in relative proximity to upper conveyor 5 (shown without conveyor belt) of the horizontal screen box 3 provided on the main mobile screening apparatus 100 as shown in FIGS. 7*a* and 7*b*. Pre-screening module 50 is also provided with a plurality of damping springs 201 which are required for the vibration function of the apparatus and also help absorb the impact of heavy bulk material being loaded onto said module and damp the vibrational forces imparted by the module during the initial sequence of pre-screening.

Referring to FIGS. 7*a*, 7*b* and FIGS. 6*a*, 6*b*, in the preferred embodiment, pre-screening module 50 is integrally provided with hanging conveyors 910 and 920 (shown without conveyor belts) which obviate the need for separate mobile wheeled stockpilers to transport the pre-screened bulk particulate material from the module 50. Conveyor 910, which extends further than conveyor 920, is deployed obliquely from the support structure 200 of pre-screening module 50 such that the largest particles separated from the bulk material may either be conveyed to a separate heap 94 (FIG. 6*a*) or be fed back to a crushing device 90*a* (FIG. 6*b*) where they can be reprocessed before being returning as recycled material via a conveyor to the pre-screening module 50 for re-screening.

With reference to FIGS. 7*a*, 7*b* and 8*a*, hanging conveyors 910, 920, (shown without conveyor belts), each comprise a beam 930 that is connected to a universal joint 931 which is rotatably mounted to the support structure 200 of pre-screening module 50. Support spars 932, which are rotatably attached to at one end to support structure 200 by means of pivotal hinges 932*a* connect via pivotal joints 932*b* to mounting members 930*a* provided on beams 930. Pivotal hinges 932*a* are vertically and horizontally offset from universal joints 931. Hydraulic rams 933 act upon support spars 932 such that when said rams are retracted, conveyors 910, 930 are deployed outwardly from mobile screening apparatus 100 as shown in FIGS. 7*a*, 7*b* and 7*c*. Upon extension of hydraulic ram 933*s*, support spars are each rotated about a plane as determined by pivotal hinges 932*a* and beams 930 are in turn moved substantially in the direction of rotation of the support spar and are thus moved inwardly towards the pre-screening module 50 and are simultaneously revolved about universal joints 931 so that the stockpilers 910, 920 are stowed substantially parallel to and vertically against, mobile screening apparatus 100 as shown in FIGS. 8*a* and 8*b*, respectively. Flexible linkages 934 which may comprise chains, cables or other suitable means extend between beams 930 and the module support structure 200 to provide additional support to the outwardly extended conveyors 910, 920 and to locate the conveyor in the optimum working position with the head drum 950 of the conveyor in a horizontal position. Further support may be provided to the conveyors by means of separately detachable rigid support spars 940 which can be connected between beams 930 and the module support structure 200 as shown in FIGS. 10*a* and 10*c*. Detailed illustrations showing the connection of a conveyor (910) to pre-screening module 50 together with the associated linkages in deployed and stowed positions are provided in FIGS. 7*c* and 8*b*, respectively.

Conveyors 8 and 9, located on opposing sides of mobile screening apparatus 100 and shown without conveyor belts in place, each comprise a beam 930 that is connected to a universal joint 935 which is rotatably mounted to chassis member 936. Support spars 937, 938 which extend upwardly from universal joints 937*a* and 938*a* attach to the underside of beam 930. An hydraulic ram 939 acts on a single support spar of the respective conveyors 8, 9 such that extension of said ram causes said support spar to move the conveyors 8,9 outwardly from a stowed position (FIG. 8*a*) to a deployed position (FIGS. 7*a*, 7*b* and 7*c*). The provision of rotatably mounted universal joints 931 and 935 enables the respective conveyors 910, 920 and 8,9 to reside within the confines of catwalk 6 and rest flat against the sides of mobile screening apparatus 100 thereby minimising its overall dimensions while in a stowed transportation mode.

With reference to FIG. 9*a* and FIG. 9*b*, to further minimise the overall dimensions of mobile screening apparatus 100, in the preferred embodiment end conveyor 7*a*, which is shown without a conveyor belt in place, is of two-part construction and is provided with a folding mechanism indicated generally by reference numeral 70 which enables the conveyor to fold back on itself. Folding mechanism 70 comprises hydraulic rams 71, 72, spaced apart lever assembly members 73, linkage arms 73*a* and support posts 74, 75. Lever assembly members 73 each comprise a substantially L-shaped member having a first limb 73*b* and second limb 73*c*. Hydraulic rams 71, 72 each extend upwardly from brackets mounted on opposing edges of the rear of mobile screening apparatus 100 and connect at their respective ends to the respective ends of opposing first limbs 73*b* of lever assembly members 73 at pivot points 730. The respective second limbs 73*c* of lever assembly members 73 are pivotably coupled to the respective sides of the upper portion of conveyor 7*a* at pivot points 76. Linkage arms 73*a*, are each pivotally connected between a lever assembly member 73 at a position proximate the intersection of first limb 73*b* and second limb 73*c* and extend upwardly towards a support post 74, 75 to which they are pivotally connected by means of fulcrums 77. This arrangement enables folding mechanism 70 to rotate about support posts 74, 75, upon actuation of hydraulic rams 71,72. From a deployed position (FIGS. 7 and 9*a*) stowing of conveyor 7*a* (FIGS. 8 and 9*b*) is facilitated by the extension of hydraulic rams 71, 72 which causes folding mechanism 70 to revolve upwardly about fulcrums 77 provided on support posts 74, 75, which in turn induces the rotation of the upper portion of conveyor 7*a* about hinges 78 which link said upper portion to the lower portion of conveyor 7*a*. Once the hydraulic rams reach their maximum extension, the upper portion of conveyor 7*a* will have revolved about hinges 78 such that said upper portion of conveyor 7*a* will be inverted and resting on top of the upper deck of the screening apparatus as shown in FIGS. 8*a* and 9*b*. From a stowed position, deployment of conveyor 7*a* is effected by the retraction of hydraulic rams 71,71 causes folding mechanism 70 to revolve downwardly about support posts 74, 75. The use of such a folding mechanism 70 on conveyor 7*a* enables the overall length and height of the mobile screening apparatus 100 while in a transportation mode to be advantageously minimised. Furthermore, the provision of a such a hydraulically operated folding mechanism 70 on the underside of conveyor 7*a* provides additional robust support to said conveyor which is particularly advantageous when the mobile screening apparatus 100 is operating with a conventional apron feeder in place (i.e. in place of pre-screening module 50) and whereby the heaviest of the screened material will be conveyed by this particular conveyor.

To further minimise the overall length of a mobile screening apparatus 100, in a further embodiment the pre-screening module 50 may be provided with an upper conveyor 51*a* which is telescopically movable along its longitudinal axis enabling it to revert from an in-use extended position to a contacted transport position as shown in FIGS. 10*a* and 10*b*, respectively. Telescopically movable upper conveyor 51*a* comprises an upper portion 51*c* and a lower portion 51*b*, wherein the lower portion 51*b* is linearly extensible relative the upper portion 51*c* to which it is slidably attached. A plurality of rams 80 which extend between each side of the pre-screening module support structure 200 and the respective sides of lower portion 51*b* enable said lower portion to move upwardly and downwardly along the side rails 51*d* of upper portion 51*c*. Upon retraction of the rams 80 the lower portion 51*b* is telescopically extended into its operating position as shown in FIG. 10*a*. Further retraction of the rams 80 causes the telescopically movable conveyor 51*a* to be raised above the upper inclined screen 57 by means of connecting arms 51*e* which are pivotably connected between hinged brackets 51*f* provided on the module support structure 200 and lifting bar 51*g* on upper portion 51*c*. Hinged brackets 51*f* also act as a stop (as shown in FIG. 10*c*) against the travel of arms 51*e* thus retaining the telescopically movable conveyor 51*a* at a correct working height above the upper inclined screen 57. Movable mounting means provided on the module support structure support the underside of telescopically movable conveyor 51*a* during use and enable said conveyor to slide smoothly between operating and transport positions. By way of example of a suitable movable mounting means, rollers 81 are shown in the figures.

Following the initial sequence of pre-screening, the particulate material subsequently presented to the main screening apparatus 1 is of a finer consistency than would otherwise be the case associated with the prior art from one machine. Furthermore, the provision of a pre-screening module having a two-deck screen box increases the versatility of the mobile screening apparatus which is able to provide at least two additional grades of screened material while still maintaining its mobility.

The material screening apparatus has a number of unique features:

- a folding mechanism for on board conveyors
- five-way split output for different grades of materials
- combined horizontal and inclined pre-screening module are mounted on the same chassis
- oversize material is taken off at the front conveyor and fed back to a crusher rather than being fed right through the apparatus
- the entire apparatus can easily be moved with a transport mode so that the weight, height and width of the apparatus are within the maximum requirements of the TÜV transport specifications and no special permit is required transport the apparatus
- the pre-screening module can be removed from, or installed on, the apparatus depending on the usage requirements in any given situation.

It is thought that the present invention and its advantages will be understood from the foregoing description and it will be understood that the invention is not limited to the specific details described therein, which are given by way of example only and that various modifications and alterations are possible within the scope of the invention as defined in the appended claims.

The invention claimed is:

1. A mobile material screening apparatus for separating bulk particulate material into groups of particles of differing sizes, the apparatus comprising:

- a support chassis;
- a horizontal screen box apparatus, the screen box mounted on the support chassis and having an upper screen deck and a lower screen deck;
- the mobile screening apparatus further comprising an additional pre-screening module, which is slideably connected to, and supported on, mounting means provided on the support chassis, the pre-screening module having an upper inclined screen and a lower inclined screen wherein the pre-screening module is provided with an upper conveyor and lower conveyor, the upper and lower conveyors being arranged parallel to the upper inclined screen and a lower inclined screen, the upper conveyor being adapted to convey material to the pre-screening module screens and the lower conveyor being adapted to transfer material from the pre-screening module to the horizontal screen box apparatus;

the screening apparatus further comprising at least one lifting ram that extends from the support chassis to the pre-screening module, the at least one lifting ram operable to move the pre-screening module between a horizontal stowed position and an operational position in which the angle of inclination of the pre-screening module is altered to thereby tilt the pre-screening module relative to the horizontal screen box, and, when the pre-screening module is being moved from the stowed position to the tilted operational position, the at least one lifting ram is further operable to simultaneously pull the pre-screening module along a plurality of rollers on the support chassis to a position above the horizontal screen box so that the particulate material is conveyed from the lower inclined conveyor to the pre-screening module to the horizontal screen box, and, whereby the provision of the horizontal screen box and the pre-screening module provides five different grades of material as output from the mobile screening apparatus, including reject unscreened material and four different grades of screened material.

2. A mobile material screening apparatus as claimed in claim 1, wherein the lifting rams are hydraulic rams.

3. A mobile material screening apparatus for separating bulk particulate material into groups of particles of differing sizes as claimed in claim 1 which is further provided with one or more folding side conveyors for sized material, the or each folding conveyor being pivotally mounted on the chassis or the pre-screening module.

4. A mobile material screening apparatus for separating bulk particulate material as claimed in claim 3, wherein the or each folding side conveyor comprises:

a beam rotatably connected to the chassis or the module support structure by means of a universal joint;

a support spar which is rotatably connected at one end to the module support structure by means of a pivotal hinge and at the other and to the beam by means of a pivotal joint, wherein the pivotal hinge is attached to the module support structure at a position that is vertically and horizontally offset from the universal joint;

and a means of rotating the support spar about the pivotal hinge whereby the rotation of the support spar is in a plane determined by the pivotal hinge and which causes the beam to move substantially in the direction of said rotation and to simultaneously revolve the beam about the universal joint so that the conveyor is moved from a deployed position to a stowed position.

5. A mobile material screening apparatus as claimed in claim 4, wherein the means of rotating the support spar about the pivotal hinge comprises a hydraulic ram.

6. A mobile material screening apparatus as claimed in claim 4, wherein a flexible linkage, which may comprise chains, cables or other suitable means, extends between the conveyor and the chassis or the module support structure to provide for support the conveyor while in a deployed configuration and to locate the conveyor in the optimum working position with the head drum of the conveyor in a horizontal position.

7. A mobile material screening apparatus for separating bulk particulate material into groups of particles of differing sizes as claimed in claim 1 wherein the upper conveyor is telescopically movable along its longitudinal axis.

8. A mobile material screening apparatus as claimed in claim 7, wherein the telescopically movable upper conveyor comprises an upper portion and a lower portion, wherein the lower portion is linearly extensible relative the upper portion to which it is slidably attached; and wherein the telescopically movable conveyor is provided with a means of extension and retraction.

9. A mobile material screening apparatus as claimed in claim 8, wherein the means of extension and retraction also raises the telescopically movable upper conveyor above the upper inclined screen.

10. A mobile material screening apparatus as claimed in claim 8, wherein the means of extension and retraction of the telescopically movable conveyor comprises:

a plurality of hydraulic rams, wherein the hydraulic rams each extend between the pre-screening module support structure and the lower portion of the telescopically movable conveyor;

a pair of connecting arms which are pivotably connected between hinged brackets provided on the module support structure and a lifting bar provided on the upper portion of the telescopically movable conveyor;

and movable mounting means provided on the module support structure, wherein the movable mounting means support the underside of the telescopic conveyor during use and enable said conveyor to slide smoothly between operating and transport positions.

11. A mobile material screening apparatus as claimed in claim 10, wherein the hinged brackets provided on the module support structure act as a stop against the travel of the arms thereby retaining the telescopic conveyor at a correct working height above the upper inclined screen.

12. A mobile material screening apparatus for separating bulk particulate material into groups of particles of differing sizes as claimed in claim 1 wherein the screening apparatus is provided with a conveyor having an end which is foldable back on itself so as to reduce the length and height of the apparatus.

13. A mobile material screening apparatus as claimed in claim 12, wherein the foldable conveyor comprises:

a two-part structure, wherein the two-part structure comprises an upper portion and a lower portion, the two portions extending end to end and connected by means of a hinged joint; and a folding mechanism, wherein the folding mechanism is adapted to revolve the upper portion of the conveyor about the hinged joint such that said upper portion becomes inverted and rests on top of the upper deck of the apparatus.

14. A mobile material screening apparatus as claimed in claim 13, wherein the folding mechanism comprises:

spaced apart lever assembly members, wherein the lever assembly members each comprise a substantially L-shaped member having a first limb and second limb;

spaced apart hydraulic rams each extending upwardly from brackets provided on the support chassis and pivotably connected at their upper ends to the ends of opposing first limbs of lever assembly members, respectively;

and linkage arms, wherein the linkage arms are each pivotably connected between spaced apart fulcrums and the respective lever assembly members at positions intermediate the first limb and second limb; and wherein the fulcrums are located on support posts provided on the support chassis.

15. A mobile material screening apparatus as claimed in claim 14, wherein the second limbs of the lever assembly members are each pivotally coupled to the respective sides of the upper portion of the foldable conveyor such that actuation of the hydraulic rams causes the folding mechanism to revolve upwardly about the support posts which in turn induces the rotation of the upper portion of the foldable conveyor.

16. A mobile material screening apparatus as claimed in claim 13 wherein the folding mechanism provides additional support to the foldable conveyor.

17. A mobile material screening apparatus as claimed in claim 1, in which the output is arranged so that the discharge of reject material is closest to the location of the material input from a material crushing apparatus and the conveyor of the reject material from the screening apparatus is located at a position and an angle so as to discharge the reject material directly back to the material crushing apparatus, thereby providing a closed circuit recycling arrangement.

18. A mobile material screening apparatus as claimed in claim 1, in which the components can be folded and stowed on the apparatus.

* * * * *